United States Patent [19]

Seely et al.

[11] Patent Number: 4,619,220

[45] Date of Patent: Oct. 28, 1986

[54] COLLAPSIBLE SIGN WITH FLAGS

[75] Inventors: James R. Seely, Rochester; Jerry A. McCabe, Union Lake, both of Mich.

[73] Assignee: Marketing Displays, Inc., Farmington Hills, Mich.

[21] Appl. No.: 792,634

[22] Filed: Oct. 28, 1985

Related U.S. Application Data

[63] Continuation of Ser. No. 573,193, Jan. 23, 1984, abandoned.

[51] Int. Cl.[4] ..... G09F 7/18

[52] U.S. Cl. ..... 116/63 P; 40/603; 116/173

[58] Field of Search ..... 40/603, 610, 612; 116/63 P, 63 R, 173; 248/176, 514, 515, 516, 528

[56] References Cited

U.S. PATENT DOCUMENTS

| | | | |
|---|---|---|---|
| 1,319,334 | 10/1919 | Hartung | 116/173 |
| 1,490,650 | 4/1924 | Wagner | 248/176 |
| 3,899,843 | 8/1975 | Doyle | 40/603 |
| 4,019,271 | 10/1977 | Latimer | 40/603 |
| 4,288,053 | 9/1981 | Sarkisian . | |
| 4,433,935 | 2/1984 | Main et al. . | |

*Primary Examiner*—Charles Frankfort
*Assistant Examiner*—Denis E. Corr
*Attorney, Agent, or Firm*—Harness, Dickey & Pierce

[57] ABSTRACT

A roll-up type portable roadside sign of the type normally used with a resilient stand member. A novel warning flag mounting system is disclosed for such sign wherein the warning flags are retained in association with the sign such that they are collapsible with the roll-up sign cross members and remain attached thereto. Such mounting is achieved by pivotably attaching the warning flag poles to the substantially vertical cross member of the sign. A rotatable support bracket is also attached to the cross member and includes a pair of spaced curled ends which receive the warning flag poles such that they extend substantially upward and are disengageable therefrom in order to permit collapsing of the sign assembly. The support bracket is rotatable such that it assumes a position substantially collinear with the remainder of the sign components, enabling the entire assembly to be quickly and conveniently stored. An alternative embodiment is described wherein means for mounting a third vertically extending warning flag rod is provided.

21 Claims, 13 Drawing Figures

COLLAPSIBLE SIGN WITH FLAGS

This application is a continuation of application Ser. No. 573,193, filed Jan. 23, 1984, now abandoned.

BACKGROUND AND SUMMARY OF THE INVENTION

This invention relates to signs and sign stand devices for displaying warnings or other pertinent information and more particularly, to an improved roadside sign of the foldable or roll-up variety. Temporary signs are particularly desirable for warning passing motorists of upcoming hazards such as are presented by construction work or emergency situations. Since such traffic hazards can occur anywhere, it is particularly desirable that these roadside signs be easily transported from one location to another and set up quickly. It is also desirable for such signs to be compact and lightweight such that a large number can be transported within a vehicle.

A number of signs according to the prior art include a plurality of upwardly extending brightly colored warning flags attached to warning flag rods which provide a high level warning for approaching motorists. These warning flag rods are attached to a holder which is affixed to a rigid sign or the vertical upright or cross member of a roll-up type sign or sign stand. Typically, these warning flag rods are removable from the associated holders and must be so removed before the sign can be collapsed for transportation from one location to another.

Examples of currently known roll-up sign designs are provided by the following copending U.S. patent applications, each of which are assigned to the same assignee as the present application: Ser. Nos. 442,418 and 442,419, both filed on Nov. 17, 1982; Ser. No. 274,400, filed June 17, 1981; and Ser. No. 497,815, filed May 25, 1983. These signs employ a flexible sign surface having one or both sides containing the desired written message or symbol. A pair of cross members are employed which are attached at their extreme ends to the roll-up sign to cause it to assume a planer shape. The cross members according to the above applications are selectively collapsible to permit the sign to either assume a display configuration or a rolled-up storage configuration. Some of these signs employ a bracket on a vertically extending cross member to which the warning flag rods are removably attached. With other signs, the holder and warning flags are attached to the top of the vertical upright on the stand assembly. Since these warning flag rods (and often the holder) become separated from the associated sign when transported, the chance for their becoming misplaced is present. Also, when the signs are moved from one location to another, the user is inconvenienced by having to separately transport a number of warning flags and holders along with the sign and then reassemble the individual parts, piece by piece. Moreover, in high winds, the flags are sometimes blown out of their holders creating a more hazardous situation and causing additional labor expense to maintain the signs.

In view of the above described shortcomings of prior art sign designs, it is a principal aspect of this invention to provide a roll-up type roadside sign which employs one or more upwardly extending warning flags which are pivotably attached to a sign cross member and which remain attached to the cross member when the sign is in the storage configuration. It is a further aspect of this invention to provide a means for attaching warning flags to a vertical cross member of a roll-up sign such that the warning flags are resistant to wind and other forces to which they are typically subjected. It is yet another aspect of this invention to provide a warning flag mounting bracket which may be permanently attached to a roll-up sign vertical cross member and which does not interfere with the compact storage of the sign.

The above principal aspects of this invention are provided by employing a roll-up sign having a pair of cross members which are typically oriented vertically and horizontally when the sign is in the assembled configuration. The warning flag rods are pivotably attached to the vertically disposed cross member such that they may be positioned collinearly with that cross member enabling the warning flags and their rods to be rolled up with the remaining components of the flexible sign when the sign is stored or transported. When the sign is assembled for use in the display configuration, these warning flags may be rotated to an upwardly projecting position and are held in place by a bracket assembly. The bracket assembly is also pivotably attached to the vertically disposed cross member and further may be rotated to an aligned position collinear with the vertical cross member, thereby permitting the bracket to be stored with the remainder of the sign.

Additional benefits and advantages of the present invention will become apparent to those skilled in the art to which this invention relates upon a reading of the described preferred embodiments of this invention taken in conjunction with the accompanying drawings.

DETAILED DESCRIPTION OF THE PREFERRED EMBODIMENTS

Figure 1:
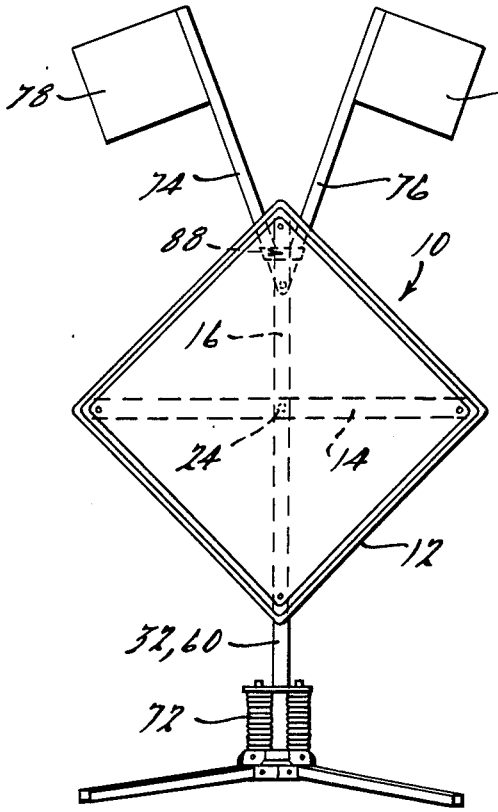
FIG. 1 is a schematic front view of a roll-up type sign in the display configuration shown with a pivoting base assembly and further shown with a pair of upwardly projecting warning flags mounted according to the teachings of this invention.
Figure 3:
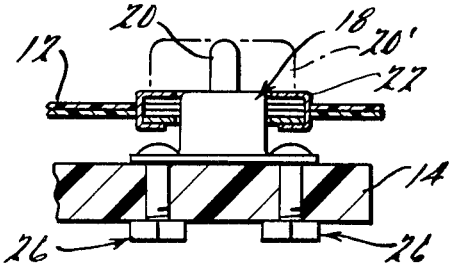
FIG. 3 is a cross-sectional view taken along line 3—3 of FIG. 2 particularly showing the fastener attaching the roll-up sign to a cross member.

Roll-up sign assemblies according to this invention are particularly shown in the display configuration with reference to FIGS. 1, 2, 7 and 9 and is generally designated by reference character 10. Roll-up sign 12 is comprised of a sheet of flexible material typically of a polymeric plastic composition such as vinyl. The side of the sign shown by FIG. 1 is impressed with a visual or written message and further would generally have a brightly colored, highly reflective or lenticular surface for maximum conspicuity. Roll-up sign 12 is supported by cross members 14 and 16, the former being generally horizontal when the sign is in the display configuration and the latter assuming a substantially vertical orientation. These cross members are adapted to cause roll-up sign 12 to assume a substantially planer surface shape thereby presenting a large warning or message area for passing motorists, such as shown, for example, in FIG. 2. At the extreme ends of cross members 14 and 16 are mounting posts 18 which provide means for attaching the roll-up sign to the cross member. One such means of providing an attachment between roll-up sign 12 and the cross members is shown by FIG. 3 and comprises providing each of the cross member extreme ends with mounting post 18 having a rotatable head 20 which in one rotated position permits mounting of grommet 22 onto the post and in another position (shown in phantom lines as 20') retains the grommet on the post. Grommet 22 is affixed to the surface of sign 12. Mounting post 18 may be affixed to the associated cross member by any conventional means, such as threaded fasteners 26, pop rivets or the like. Alternately, sign 12 could form individual pockets at each of its extreme corner ends, thus affixing the cross members to the sign when the cross member ends are inserted within these pockets.

Figure 10:
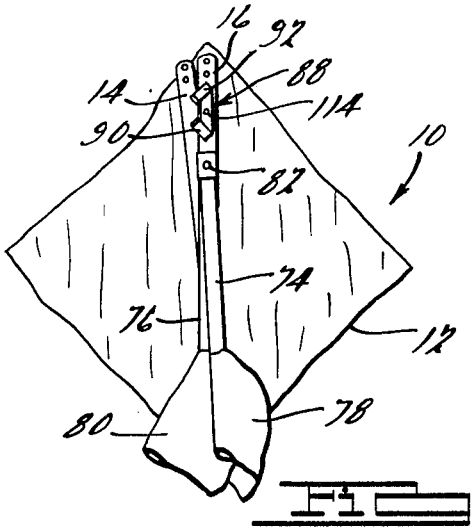
FIG. 10 shows the components of the sign in accordance with the present invention in a partially folded position prior to storage.

Cross members 14 and 16 are formed from a substantially rigid material such as reinforced plastic or wood. Preferably, cross members 14 and 16 are rotatable relative to one another about pivot pin 24 which permits the cross members to be collapsed from the orientation shown by FIG. 2 to assume a collinear relationship, as shown in FIG. 10, which provides maximum compactness when the sign is collapsed to the storage configuration.

Figure 2:
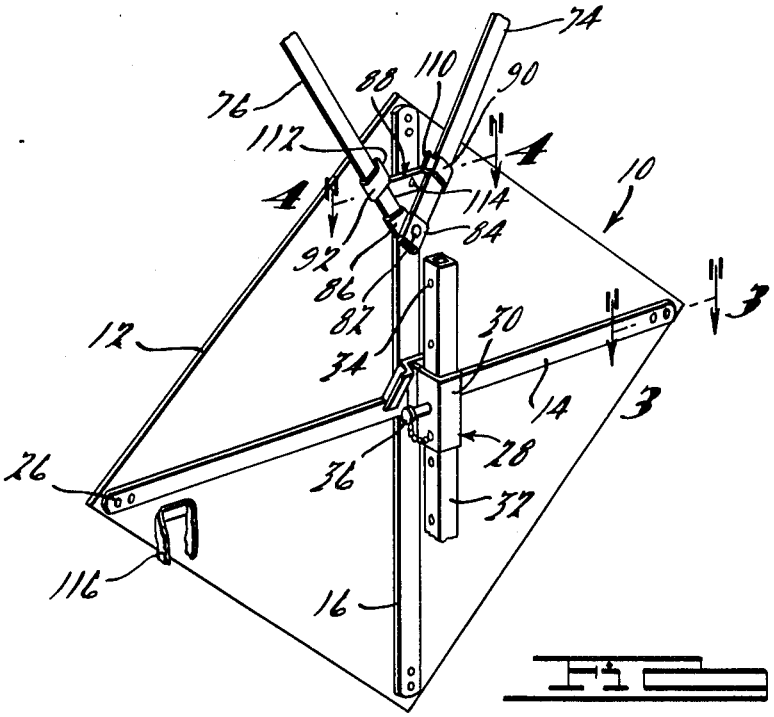
FIG. 2 is a rear view of a roll-up type sign in the display configuration showing the upwardly projecting warning flags and the warning flag mounting system according to the teachings of this invention.
Figure 5:
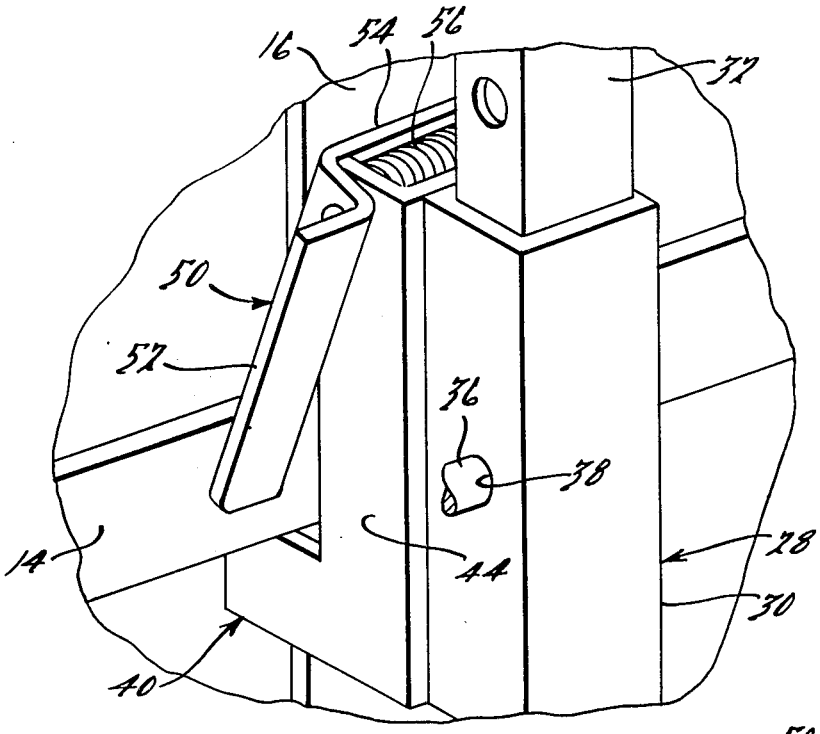
FIG. 5 is a perspective view of an adjustable sign bracket employed to hold the roll-up sign on the vertical upright of a sign stand assembly.
Figure 6:
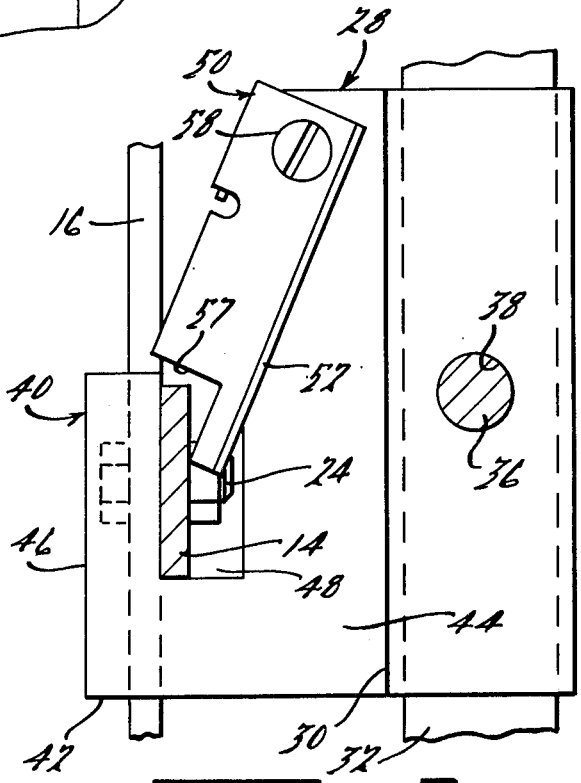
FIG. 6 is a side view of the adjustable sign bracket illustrated by FIG. 4.

Several means for affixing roll-up sign assembly 10 to a mounting base are described herein. With reference to FIGS. 2, 5 and 6, one such method is illustrated which is taught by pending U.S. patent application Ser. No. 442,419 previously cited. According to these Figures, an adjustable sign mounting bracket 28 is provided having a sleeve-type mounting member 30 which slidably overfits vertical upright sign stand members 32. Member 32 is part of a sign stand assembly preferably of the wind resistant type, as will be described subsequently. Upright member 32 includes a plurality of holes 34 which cooperate with locking pin 36 and hole 38 in mounting member 30 such that the adjustable sign mounting bracket 28 may be positioned at various vertical positions on the sign stand assembly as desired with regard to the particular circumstances presented.

With particular reference to FIGS. 5 and 6, attached to mounting member 30 is cross member engaging portion 40 which includes a pair of spaced horizontal cross member engaging legs 42, each forming an inner leg 44, outer leg 46 and channel 48 therebetween. Affixed to inner leg 44 is spring biased latching member 50, having a pair of legs 52 connected to a bridge portion 54. Latching member 50 is biased by torsion spring 56 such that legs 52 are urged toward outer leg 46. Cross member engaging portion 40 is adapted to receive cross members 14 and 16 such that the vertical cross member 16 is positioned between engaging legs 42 whereas the horizontal cross member 14 is received by channel 48 and is resiliently biased in position there by latching member 50. Shoulder 57 on latching member 50 helps retain cross member 14 in position in bracket 28.

Figure 7:
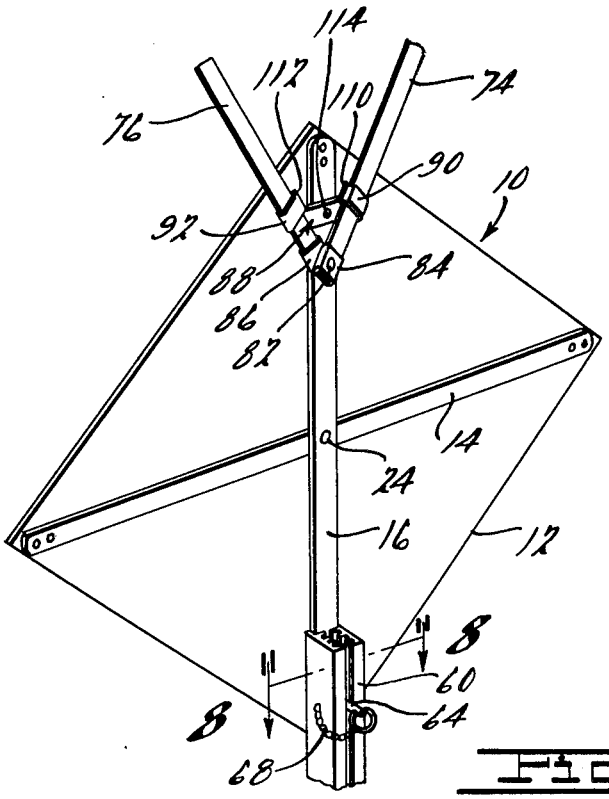
FIG. 7 is a rear perspective view of a roll-up type sign showing another method for attaching the roll-up sign to a sign stand assembly.
Figure 8:
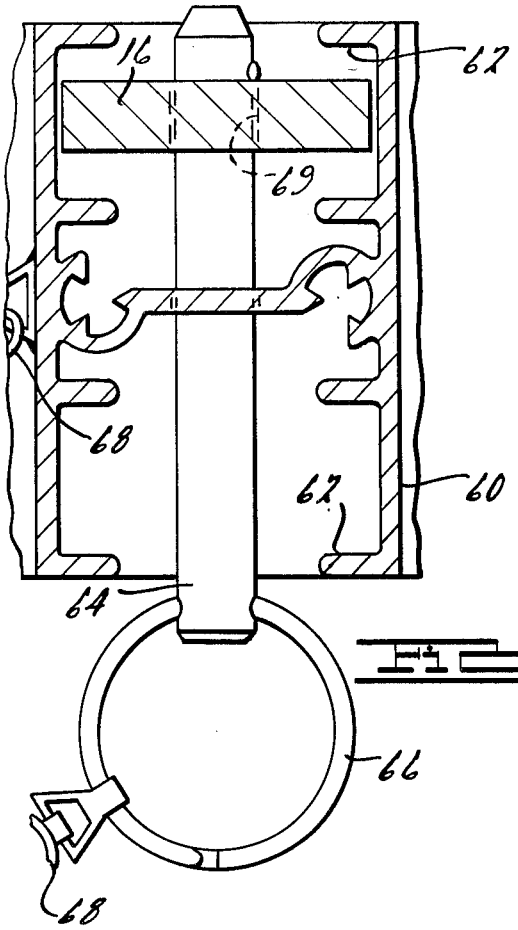
FIG. 8 is a cross-sectional view taken along line 8—8 of FIG. 7 and illustrates the positioning of the vertical sign cross member within the sign stand assembly with a locking pin installed.
Figure 9:
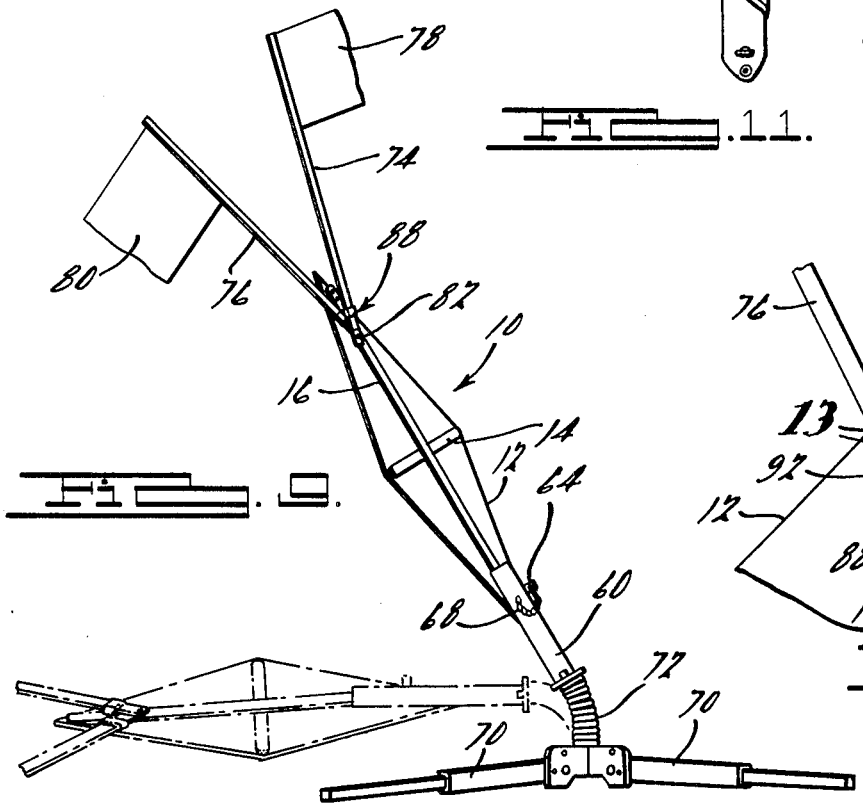
FIG. 9 is a side perspective view showing in solid lines a sign subjected to wind forces in a partially deflected position, and showing in phantom lines a fully deflected sign stand subjected to strong wind forces.

An alternate means for mounting roll-up sign assembly 10 to a stand frame is illustrated by FIGS. 7, 8 and 9 and is described by application Ser. No. 442,418 previously cited. This system employs a short vertical upright member 60 which is adapted to receive the lower portion of vertical cross member 16. Briefly, this system employs upright member 60, forming one or more vertical channels 62 within which vertical cross member 16 is disposed. The cross member is retained in position with respect to upright member 60 by locking pin 64, preferably which is attached to the sign stand by ring 66 and chain 68. For this purpose, hole 69 is provided in cross member 16. Upright member 60 is attached to a base which includes a plurality of extendable leg sections 70 which are telescoping and foldable, thereby permitting the entire stand to be readily stored and transported.

FIGS. 1 and 9 illustrate sign stands having angularly deflectable coil springs 72 which permit the sign to be deflected toward the ground when subjected to wind forces or other externally applied loads. The position of the sign shown in phantom lines in FIG. 9 depicts the position of the sign when subjected to a high wind force striking the sign 12. The springs 72 are preloaded with an initial tension between the coils thereof as more fully set forth in U.S. Pat. Nos. 3,646,696 and 3,662,482, the disclosures of which are hereby incorporated by reference. The initial tension is set to a prespecified amount (based on the characteristics of the sign and stand) so that springs 72 will hold the vertical upright member of the sign stand (and the sign) steady and in the vertical position in little or no wind and yet allow the sign and vertical upright member to deflect in high wind forces which would otherwise topple over the entire sign stand assembly or slide it along the ground. Due to the features and characteristics of the sign stand with such coil springs 72, the sign stand can have a virtually weightless base and still be virtually uptippable in high winds.

Roadside signs typically provide one or more upwardly projecting warning flags which extend in a generally vertically upward position above the top of the sign. According to the prior art, such warning flags are attached to rods which are affixed to a vertical upright member of the stand assembly or to the vertically extending cross member of a roll-up type sign by a demountable bracket assembly within which the warning flag rods are inserted. In accordance with the present invention, the novel means for utilitzing and attaching warning flags to a roll-up type sign is shown particularly with reference to FIGS. 2, 4, 7 and 9. As shown by these Figures, two upwardly projecting warning flag rods 74 and 76 are provided. These rods support highly visible warning flags 78 and 80, respectively. Warning flag rods 74 and 76 are pivotably attached together and to vertical cross member 16 by pivot pin mechanism 82. Pin mechanism 82 provides a shaft upon which flag rods 74 and 76 are journaled for rotation, and may be in the form of a rivet or a threaded fastener with a lock nut. Since warning flag rods 74 and 76 may be rotated about pin 82, they may be caused to assume a collinear position with respect to cross member 16, as shown by FIG. 10.

The ends of rods 74 and 76 may be reinforced by providing metal sleeves 84 and 86 through which pin 82 pases. Since it is desirable that all of the elongated members be mounted such that they may be foldable onto one another, it is preferred to attach warning flag rods 74 and 76 to a surface of cross member 16 opposite the surface of that cross member to which the other cross member 14 is attached (this arrangement is best shown in FIG. 7).

Figure 4:
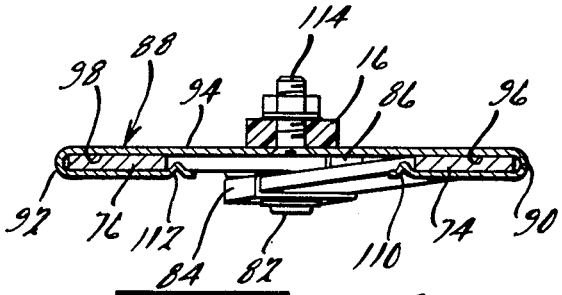
FIG. 4 is a cross-sectional view taken along line 4—4 of FIG. 2 particularly showing the warning flag rod support bracket according to this invention.

Warning flag rods 74 and 76 are positioned in an upright position through engagement with warning flag rod support bracket 88. As best shown by FIG. 4, bracket 88 is formed from a substantially elongated piece of sheet stock which forms a pair of curled ends 90 and 92 joined by intermediate section 94. Ends 90 and 92 form channels 96 and 98 which closely receive rods 74 and 76 respectively. The ends 90 and 92 are angled slightly vertically upwardly as is evident from FIGS. 2 and 7, such that channels 96 and 98 are aligned with the associated warning flag rods 74 and 76. Ends 90 and 92 have deflectable bent flanges 110 and 112 which form restricted openings for channels 96 and 98 and act to trap rods 74 and 76 therein. Intermediate section 94 is pivotably affixed to cross member 16 by fastener 114 which is positioned between pin 82 and the upper end of cross member 16. The arms 110 and 112 may be deflected enabling rods 74 and 76 to be inserted within channels 96 and 98 and removed, yet sufficient tension is provided to prevent the warning flag rods from being inadvertently disengaged from the channels.

Figure 11:
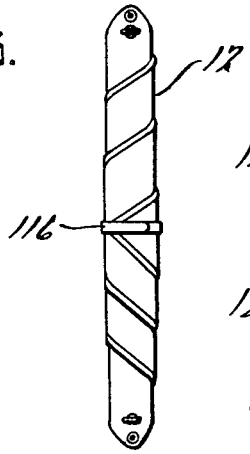
FIG. 11 shows the inventive sign in the storage configuration such that the rigid sign components are folded completely within the flexible sign panel.

Storage of sign assembly 10 is accomplished first by dismounting the sign assembly from the associated sign stand and then unfastening one of the cross members 14 and 16, preferably member 14, from sign 12. Next, warning flag rods 74 and 76 are each disengaged from support bracket 88. Cross members 14 and 16 are rotated such that they assume a substantially collinear relationship. Similarly, warning flag rods 74 and 76 are also rotated about pin 82 until they are substantially collinear with members 14 and 16 and with each other. Thereafter, support bracket 88 is rotated such that intermediate section 94 is aligned substantially parallel with cross member 16. Having completed these steps, the roll-up sign assembly 10 assumes the configuration depicted by FIG. 10. Thereafter, sign 12 is tightly wrapped or rolled up about the remaining components forming an elongated cylindrically-shaped package as shown in FIG. 11. Means for retaining sign 12 in the storage configuration is provided by fastening tape 116 preferably of the hook and loop variety, such as VELCRO material (VELCRO is a trademark for a fastener type owned by VELCRO USA, Inc., 521 Fifth Avenue, New York, N.Y.). Preferably, the fastener 116 is attached directly to the sign 12 (as shown in FIG. 2) so that it will not be misplaced when the sign is being displayed. As is evident from the compactness of the sign in the storage configuration shown by FIG. 11, a large number of roll-up sign assemblies 10 could be carried easily within a vehicle.

Figure 13:
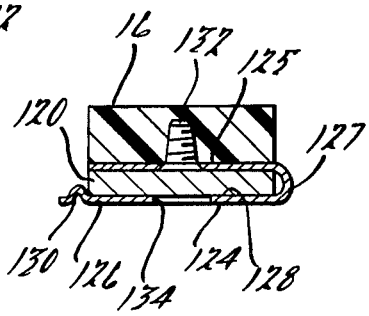
FIG. 13 is a cross-sectional view taken along line 13—13 of FIG. 12 showing particularly one of the flag warning flag rod supporting brackets.
Figure 12:
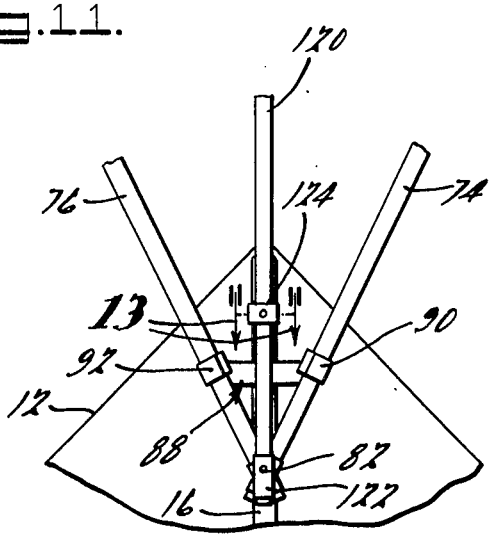
FIG. 12 is a partial rear view of a roll-up type sign illustrating a second embodiment of a warning flag rod support bracket useful for supporting three individual warning flags.

An alternate embodiment of this invention is depicted by FIGS. 12 and 13 wherein three vertically upwardly extending warning flag rods are employed. Warning flag rods 74 and 76 are supported in a manner identical to that of the previous embodiment, including warning flag rod supporting bracket 88. This embodiment differs, however, in that an additional vertically extending warning flag rod 120 is employed. This warning flag rod is also pivotably attached to cross member 16 by pivot pin mechanism 82 and has a reinforcing metal sleeve 122 on its lower end. An additional warning flag rod supporting bracket 124 is employed which removably supports warning flag rod 120 in a vertical position. With reference to FIG. 13, bracket 124 forms a generally "C" shaped section with a back section 125, a front section 126, a curled end 127 and a channel 128. Channel 128 has a deflectable bent flange 130 at its open end and is adapted to closely receive and retain rod 120 within it. Bracket 124 is fastened to cross member 16 by fastener 132. An access opening 134 is provided on the front section 126 so that fastener 132 can be connected to cross member 16.

The assembly and disassembly of the three-flag sign embodiment of FIGS. 12 and 13 is substantially the same as that described above relative to the two-flag sign embodiment, except that a third flag rod 120 is involved. In this regard, the detachment of flag rod 120 from bracket 124 and its rotation to a collinear position with cross members 14 and 16 is carried out in the same manner as the detachment of flag rods 74 and 76 from bracket 88 and their rotation into alignment with members 14 and 16.

It is also within the scope of this invention to mount warning flag rod supporting bracket 88 to a vertically disposed pole or frame member extending from a sign stand rather than to roll-up sign cross member 16. Such a configuration would retain the warning flags in association with the sign stand instead of with the remainder of the roll-up sign assembly 10. Additionally, warning flag rod supporting bracket 74 may be employed in connection with a rigid or semi-rigid sign, in which case the bracket would be affixed either to a vertical cross member or to the sign itself.

While the above description constitutes the preferred embodiments of the present invention, it will be appreciated that the invention is susceptible to modification, variation and change without departing from the proper scope and fair meaning of the accompanying claims.

What is claimed is:

1. In a sign assembly of the type being collapsible from a display configuration to a storage configuration, the sign assembly having at least one cross member supporting a sign, and further having at least one warning flag attached to a corresponding warning flag rod, the improvement comprising:

a first pivot means having a shaft and being affixed to said cross member for pivotably attaching the warning flag rod thereto;

a second pivot means affixed to the cross member; and a warning flag support bracket pivotally attached to said cross member by said second pivot means, said warning flag support bracket having at least one curled end, said flag rod being journaled for rotation about said shaft of said first pivot means and said curled end being positionable to limit the pivotal movement of said flag rod in at least one rotational direction to hold said flag in the display configuration but otherwise free of rotational restraint, the warning flag rod and said bracket further being selectively pivotable into a substantially collinear relationship with respect to said cross member when the sign assembly is in the storage configuration, the warning flag rod extending in the display configuration in a generally opposite direction from that of the warning flag rod in the storage configuration.

2. The improvement according to claim 1, wherein the cross member assumes a substantially vertical orientation when the sign assembly is in the display configuration, the warning flag rods and said warning flag support bracket being pivotably attached to the cross member by said first and second pivot means.

3. The improvement according to claim 2, wherein said first pivot means is located vertically below said second pivot means on the cross member.

4. The improvement according to claim 1, wherein said bracket curled end partially encircles the warning flag rod and defines a channel within which the warning flag rod is releasably insertable.

5. The improvement according to claim 2, wherein two of the warning flag rods are pivotally attached to the cross member, and said warning flag support bracket includes two curled ends, said curled ends being spaced apart by an intermediate bracket section which is pivotably attached to the first cross member by said second pivot means.

6. The improvement according to claim 5, wherein a third warning flag rod is pivotally attached to the cross member, and a second warning flag supporting bracked is affixed to the cross member and is adapted to selectively engage or disengage the third warning flag rod.

7. The improvement according to claim 4, wherein said bracket curled end includes a dependent end formed to restrict the opening into said channel such that said dependent end must be deflected in order to selectively insert or remove the warning flag rod therein, whereby inadvertent removal of the warning flag rod from said channel is substantially prevented.

8. In a sign assembly of the type being collapsible from a display configuration to a rolled-up storage configuration, the sign assembly having first and second cross members supporting a flexible sign, the first cross member extending vertically when the sign is in the display configuration, the sign further having two warning flags attached to corresponding first and second warning flag rods, the improvement comprising:

a first pivot means affixed to the first cross member for pivotably attaching the first and second warning flag rods thereto;

a second pivot means affixed to the first cross member; and a warning flag support bracket pivotably attached to the first cross member by said second pivot means, said warning flag support bracket having a pair of spaced apart curled ends, said curled ends adapted for selectively engaging and disengaging the first and second warning flag rods, the warning flag rods and said bracket being pivoted with respect to the first cross member such that said bracket curled ends engage the warning flag rods when the sign is in the display configuration but otherwise free of rotational restraint, the warning flag rods and said bracket further being selectively pivotable into a substantially collinear relationship with respect to the first cross member when said sign assembly is in the storage configuration, the warning flag rods extending in the display configuration in a generally opposite direction from that of the warning flag rods in the storage configuration.

9. In a sign assembly of the type being collapsible from a display configuration to a rolled-up storage configuration, the sign assembly having first and second cross members supporting a flexible sign, the first cross member extending vertically when the sign is in the display configuration, the sign further having three warning flags attached to corresponding first, second and third warning flag rods, the improvement comprising:

a first pivot means affixed to the first cross member for pivotably attaching the first, second and third warning flag rods thereto;

a second pivot means affixed to the first cross member;

a first warning flag support bracket pivotably attached to the first cross member by said second pivot means, said first warning flag support bracket having a pair of spaced apart curled ends, said curled ends adapted for selectively engaging and disengaging the first and second warning flag rods; and a second warning flag support bracket attached to said first cross member adapted for selectively engaging and disengaging the third warning flag rod, the first, second and third warning flag rods and said first bracket being pivoted with respect to the first cross member such that said first bracket curled ends engage the first and second warning flag rods when the sign is in the display configuration but otherwise free of rotational restraint, the first, second and third warning flag rods and said first bracket further being selectively pivotable into a substantially collinear relationship with respect to the first cross member when the sign assembly is in the storage configuration, the first, second and third warning flag rods extending in the display configuration in a generally opposite direction from that of such warning flag rods in the storage configuration.

10. A sign display assembly having a flexible sign, a pair of cross members and at least one warning flag, attached to a support means, the improvement comprising:

the flexible sign being attached to at least one of the cross members;

the cross members being joined together by a first pivot means and being rotatable relative to one another to a first position for display of the flexible sign and to a second position substantially collinear to one another for collapse and storage of the sign;

the support means for the warning flag being attached to one of said cross members by a second pivot means and being rotatable about said second pivot means free of restraint to a first position for display of the warning flag and to a second position substantially collinear to one of said cross members for storage of the sign and warning flag about said second pivot means free of restraint;

said second pivot means being on one side of one of the cross members relative to said first pivot means and said warning flag when said support means are in said second position being on the opposite side of said cross-member; and bracket means for holding said support means in said first position for display of the warning flag.

11. The sign display assembly as set forth in claim 10, wherein said bracket means is attached to one of said cross members by a third pivot means and is rotatable to a first position for display of the warning flag and to a second position for storage of the sign.

12. The sign display assembly as set forth in claim 10, wherein at least two support means are provided, each with a warning flag thereon and each of said support means being attached to said one of said cross members by the same second pivot means and each being held in said first position for display of the warning flag by said bracket means.

13. The sign display assembly set forth in claim 10, wherein said bracket means releasably holds said support means in said first position for display of the warning flag.

14. The sign display assembly set forth in claim 12, further comprising a second bracket means and a third support means with a warning flag thereon.

15. In a sign assembly of a type being collapsible from a sign display configuration to a sign storage configuration, the sign assembly having at least one longitudinally-extending sign support member for supporting a sign in a sign display configuration and further having at least one warning flag rod, the improvement comprising:

first pivot means affixed to the sign support member for pivotally attaching the warning flag rod thereto for pivotal movement between a warning flag display disposition projecting generally outwardly relative to the sign and a warning flag storage orientation generally longitudinally aligned with the longitudinally-extending sign support member and disposed generally inwardly relative to the sign;

a warning flag support bracket having at least one rod retention means thereon for releasably retaining said rod in said warning flag display orientation; and second pivot means affixed to the sign support member for pivotally attaching the warning flag support bracket thereto for pivotal movement between a support bracket display orientation extending in a generally transverse direction relative to the longitudinal-extending sign support member and a support bracket storage orientation generally longitudinally aligned with the longitudinally-extending sign support member and extending in said generally inward direction relative to the sign, said rod retention means being engageable with said rod for releasably retaining said rod in said warning flag display orientation when said warning flag support bracket is pivoted to said support bracket display orientation.

16. The improvement according to claim 15, wherein said rod member retention means includes at least one curled end portion thereon, said curled end portion selectively limiting the pivotal movement of said rod in at least one pivotal direction in order to releasably retain said rod in said warning flag display orientation.

17. The improvement according to claim 16, wherein the sign support member extends in a generally vertical orientation when the sign assembly is in the sign display configuration, said first pivot means being located generally vertically below said second pivot means on the sign support member.

18. The improvement according to claim 16, wherein said curled end portion of said support bracket partially encircles the warning flag rod and defines a channel within which the warning flag rod is releasably receivable.

19. The improvement according to claim 18, wherein two of the warning flag rods are pivotally attached to the sign support member by said first pivot means, said warning flag support bracket having two curled end portions generally at opposite ends thereof, said curled end portions being spaced apart by an intermediate bracket section pivotably attached to the sign support member by said second pivot means.

20. The improvement according to claim 19, wherein a third warning flag rod is pivotally attached to the sign support member by said first pivot means, and a second warning flag support bracket is affixed to the sign support member, said second warning flag support bracket including second rod retention means thereon for releasably retaining said second warning flag rod in said warning flag display orientation.

21. The improvement according to claim 18, wherein said curled end portions of said support bracket include a dependent end formed to restrict the opening into said channel such that said end must be deflected in order to selectively insert or remove the warning flag rod therein, whereby inadvertent removal of the warning flag rod from said channel is substantially prevented.

* * * * *

UNITED STATES PATENT AND TRADEMARK OFFICE

CERTIFICATE OF CORRECTION

PATENT NO. : 4,619,220

DATED : October 28, 1986

INVENTOR(S) : James R. Seely

It is certified that error appears in the above-identified patent and that said Letters Patent is hereby corrected as shown below:

| | |
|---|---|
| Column 1 line 42 | "planer" should be --planar-- |
| Column 3 line 28 | "planer" should be --planar-- |
| Column 5, line 1 | "utilitzing" should be --utilizing-- |
| Column 5, line 18 | "pases" should be --passes-- |
| Column 7, line 38 | "bracked" should be --bracket-- |

Signed and Sealed this

First Day of September, 1987

*Attest:*

*Attesting Officer*

DONALD J. QUIGG

*Commissioner of Patents and Trademarks*